US011350225B2

(12) United States Patent
Newton et al.

(10) Patent No.: US 11,350,225 B2
(45) Date of Patent: May 31, 2022

(54) PERSONAL SOUND AMPLIFICATION ARTICLE AND METHOD FOR IMPLEMENTING SAME

(71) Applicants: Victoria C. Newton, East Haddam, CT (US); Ralph T. Campagna, Pomfret Center, CT (US)

(72) Inventors: Victoria C. Newton, East Haddam, CT (US); Ralph T. Campagna, Pomfret Center, CT (US)

( * ) Notice: Subject to any disclaimer, the term of this patent is extended or adjusted under 35 U.S.C. 154(b) by 38 days.

(21) Appl. No.: 16/875,305

(22) Filed: May 15, 2020

(65) Prior Publication Data

US 2021/0360355 A1 Nov. 18, 2021

(51) Int. Cl.

| | |
|---|---|
| ***H04R 25/00*** | (2006.01) |
| ***H04R 25/02*** | (2006.01) |
| ***A44C 7/00*** | (2006.01) |

(52) U.S. Cl.

CPC ..... *H04R 25/505* (2013.01); *A44C 7/004* (2013.01); *H04R 25/02* (2013.01); *H04R 25/554* (2013.01); *H04R 25/602* (2013.01); *H04R 25/65* (2013.01)

(58) Field of Classification Search

CPC .... H04R 25/02; H04R 25/554; H04R 25/602; H04R 25/65

See application file for complete search history.

(56) References Cited

U.S. PATENT DOCUMENTS

| | | | | |
|---|---|---|---|---|
| 5,828,757 A * | 10/1998 | Michalsen | ..... | H04R 25/502 381/328 |
| 2014/0098983 A1* | 4/2014 | Clow | ..... | H04R 1/10 381/375 |
| 2014/0323183 A1* | 10/2014 | Klein | ..... | H04M 1/6066 455/569.1 |

* cited by examiner

*Primary Examiner* — Phylesha Dabney

(74) *Attorney, Agent, or Firm* — Steven M. McHugh

(57) ABSTRACT

A Personal Sound Amplification System is provided in accordance with one embodiment of the invention and includes a Personal Sound Amplification Device (PSAD), a receiving module and an external sound tube, wherein the PSAD includes a power module having a power source. The receiving module includes a receiving module body having a module body top and defining a receiving module body cavity for containing module electronics, wherein the receiving module is configured to removably associate with a decorative jewelry cover. Moreover, the external sound tube may be associated with the module body top of the receiving module.

19 Claims, 22 Drawing Sheets

SECTION A-A

CLOSED CONFIGURATION

OPEN CONFIGURATION

PERSONAL SOUND AMPLIFICATION ARTICLE AND METHOD FOR IMPLEMENTING SAME

FIELD OF THE INVENTION

The present invention relates generally to hearing aids, and more particularly to a personal sound amplification device configured as an earring.

BACKGROUND OF THE INVENTION

Hearing aids are well known and are useful for a variety of pathologies, including sensorineural hearing loss, conductive hearing loss and single-sided deafness. Typically, the hearing aid candidacy is determined by a licensed individual (such as an audiologist or hearing instrument specialist) who examines the patient to determine the type of hearing loss and fits the hearing aid device to the patient based on the nature and degree of the hearing loss. This is important because the amount of benefit experienced by the user of the hearing aid is multi-factorial, depending on the type, severity, and etiology of the hearing loss, the technology and fitting of the device, and on the motivation, personality, lifestyle, and overall health of the user. It should be appreciated that hearing aids are incapable of correcting hearing loss. Rather, they are used to make sounds more audible so that the sounds can reach the cochlea and auditory nerve, where the cochlea and auditory nerve are able to transmit signals to the brain normally.

Currently, there are many different devices to make sounds more audible to hearing loss patients and they range from body-worn devices to behind-the-ear devices to in-the-ear devices to devices that include a directional microphone. One such example is called a Personal Sound Amplification Device (PSAD) which is a simple device that amplifies sound for a wearer. PSADs are typically used for individuals that have some degree of hearing loss, but whose hearing loss is not severe enough for a hearing aid. The FDA has not approved PSADs as a medical device and classifies PSADs as wearable electronic products for occasional, recreational use by consumers who are not hearing impaired. Other examples include medical devices, or hearing aids, of which there are several different types. Current styles of hearing aids include body worn hearing aids, eyeglass hearing aids, behind the ear (BTE) hearing aids, receiver in the ear canal BTE (RIC) hearing aids, in the canal (ITC) hearing aids, completely in the canal (CIC) hearing aids and out of the ear (OTE) hearing aids. Unfortunately, however, while these current devices do work, there are some deficiencies. For example, while the BTE and RIC styles are the most popular at 80%+ in the marketplace, the initial reaction to the look of the device may seem old fashioned to some consumers. Additionally, the ITE, ITC and CIC hearing aid styles create an occlusion effect and make the wearer's voice sound like it's in a barrel and give a 'plugged up' sensation. This occlusion occurs when the hearing aid wearer's own voice is trapped in the ear canal by the hearing aid blocking the air canal. Another example includes power BTE style of hearing aids which include a larger electronic enclosure to house the receiving and processing electronics. The BTE style typically fits over the ear with an earmold or earplug located either at the entrance of, or in, the ear canal, wherein the electronics are located behind the ear. Unfortunately, however, these styles are relatively large and more obvious to people who encounter the wearer.

SUMMARY OF THE INVENTION

A Personal Sound Amplification System is provided in accordance with one embodiment of the invention and includes a Personal Sound Amplification Device (PSAD), a receiving module and an external sound tube, wherein the PSAD includes a power module having a power source. The receiving module includes a receiving module body having a module body top and defining a receiving module body cavity for containing module electronics, wherein the receiving module is configured to removably associate with a decorative jewelry cover. Moreover, the external sound tube may be associated with the module body top of the receiving module.

A Personal Sound Amplification System is provided in accordance with another embodiment of the invention and includes a Personal Sound Amplification Device (PSAD) and an external sound tube. The PSAD includes a receiving module having an attaching means for associating with a decorative jewelry cover, and a receiving module body having a module body top and defining a receiving module body cavity for containing module electronics. The external sound tube may be associated with the module body top of the receiving module.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike in the several Figures.

DETAILED DESCRIPTION OF THE INVENTION

Figure 1:
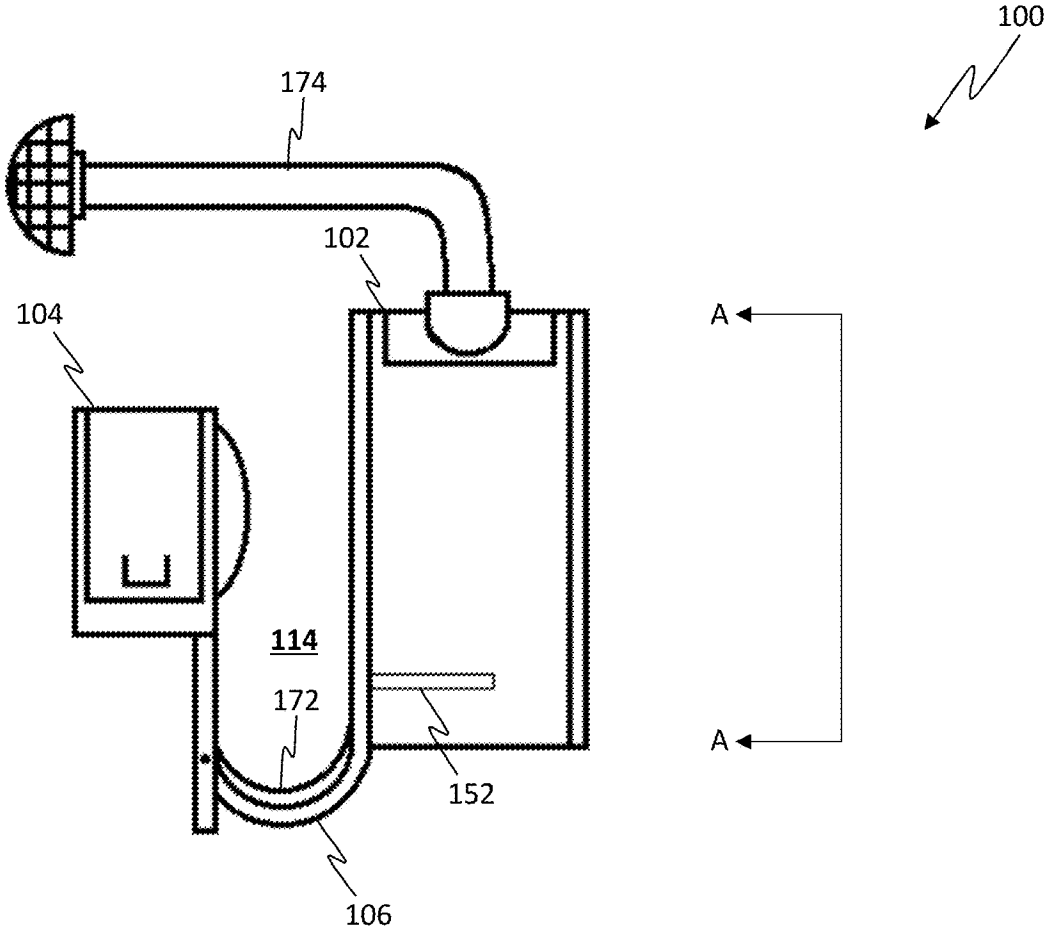
FIG. 1 is a side view of a Personal Sound Amplification Device (PSAD), in accordance with one embodiment of the invention.
Figure 2A:
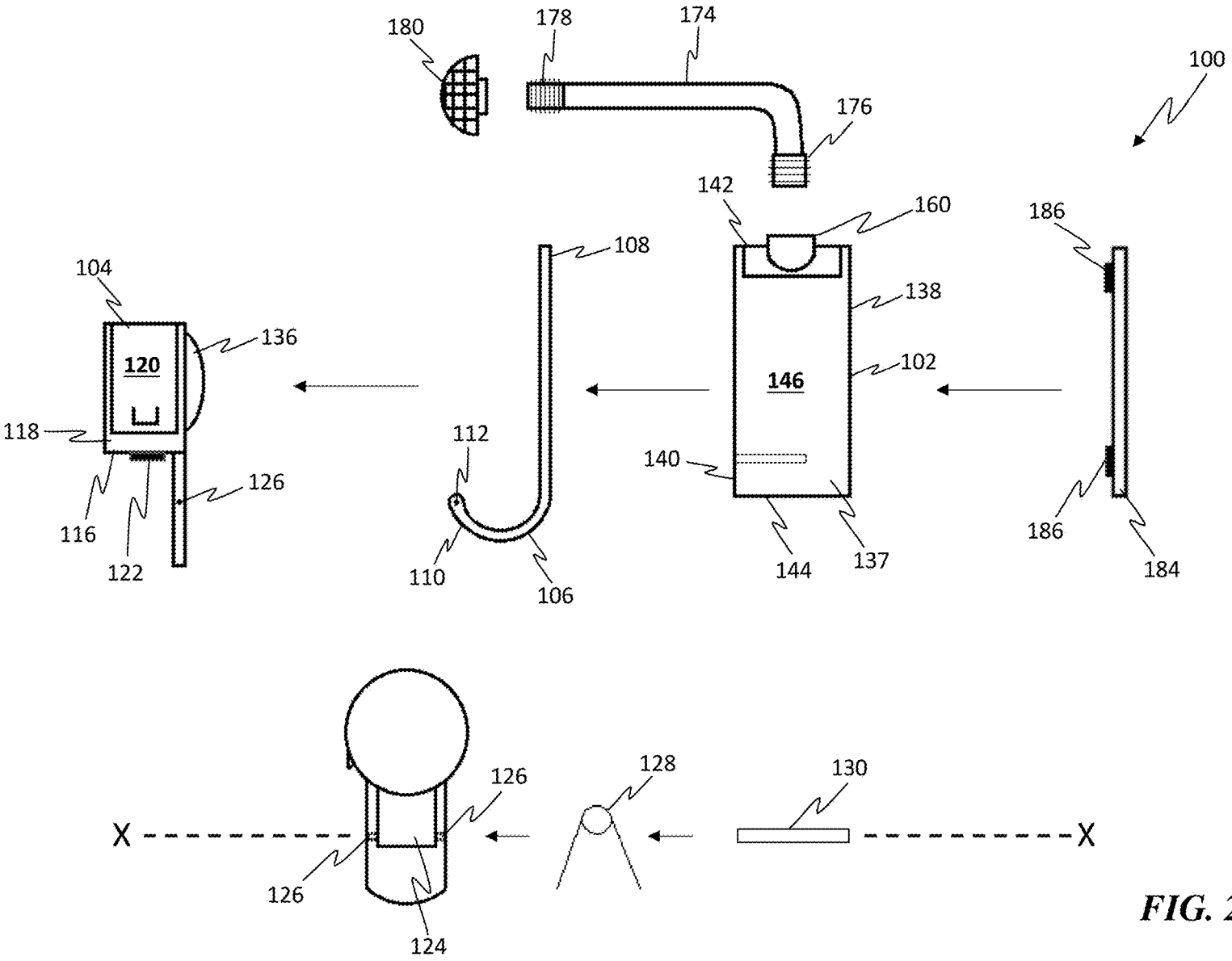
FIG. 2A is an exploded view of the PSAD of FIG. 1.
Figure 2B:
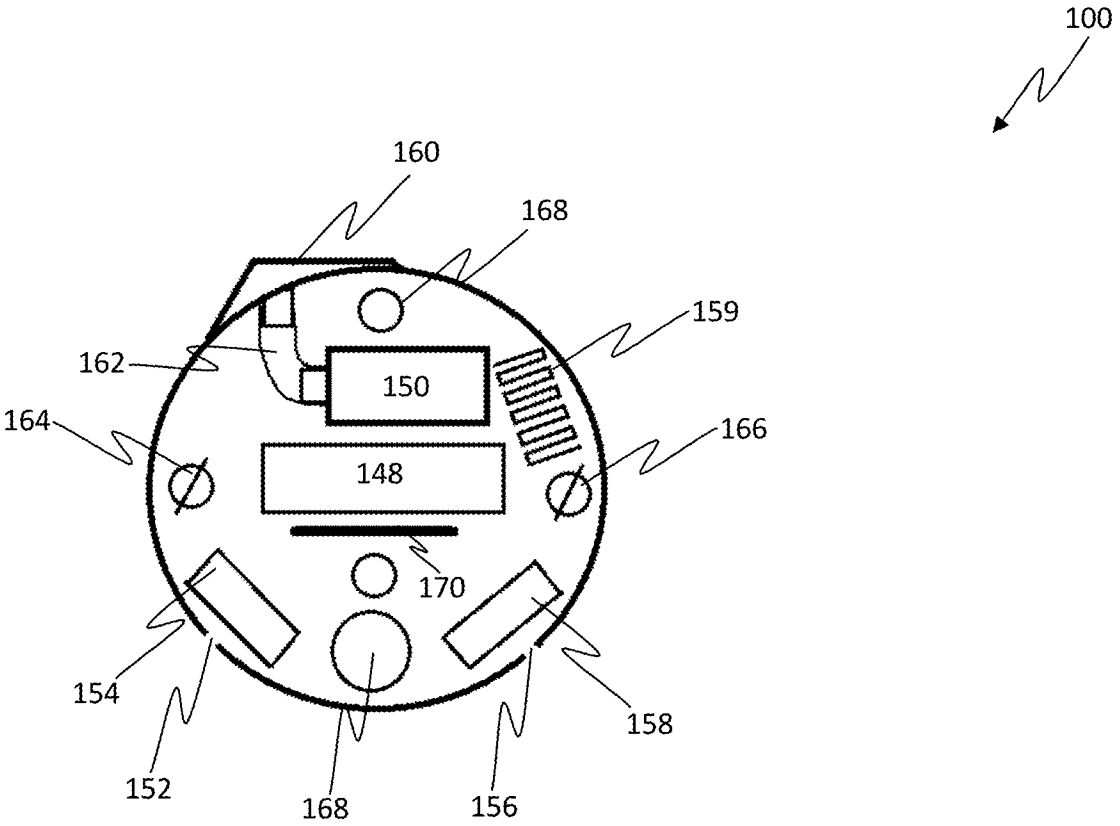
FIG. 2B is a sectional view of the receiving module of the PSAD of FIG. 1, showing electronic elements of the PSAD.
Figure 3A:
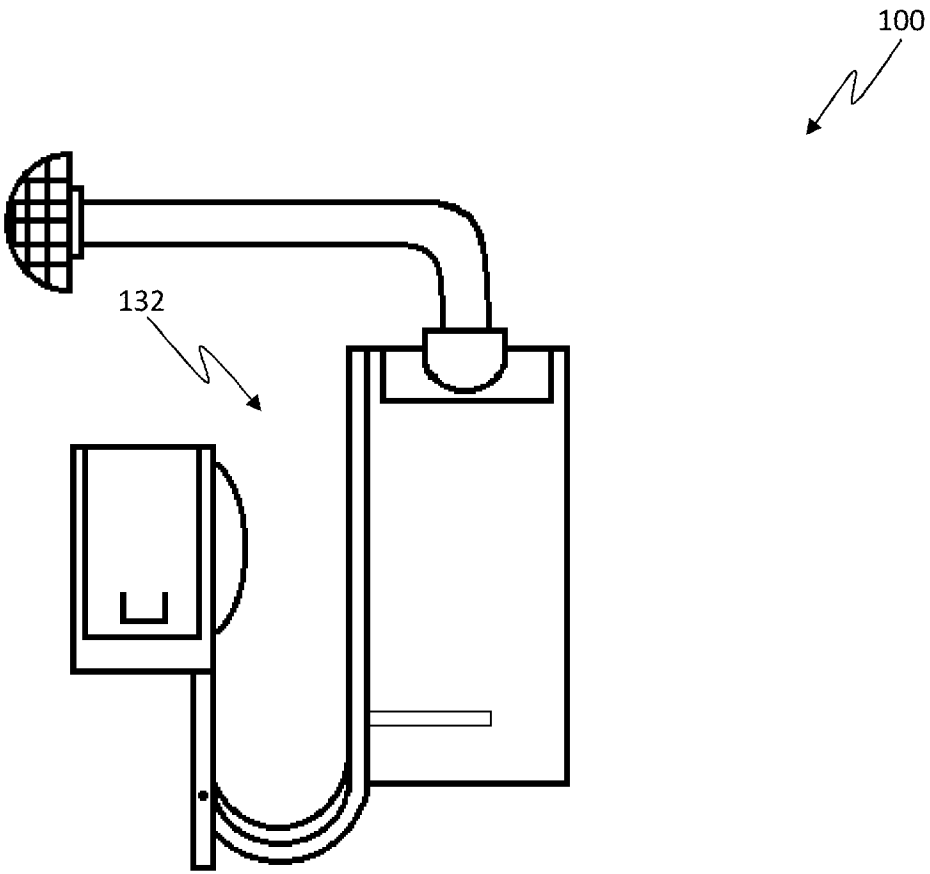
FIG. 3A is a side view of the PSDA of FIG. 1 configured in the closed configuration, in accordance with one embodiment of the invention.
Figure 3B:
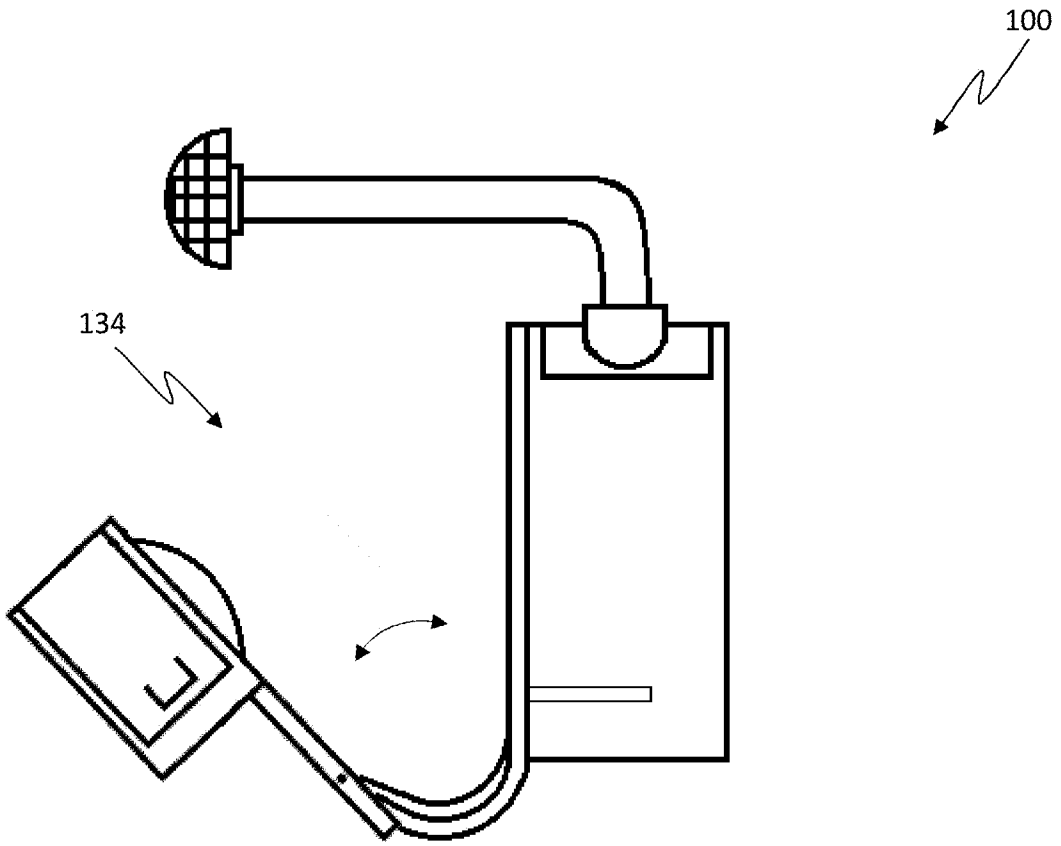
FIG. 3B is a side view of the PSDA of FIG. 1 configured in the open configuration, in accordance with one embodiment of the invention.
Figure 3C:
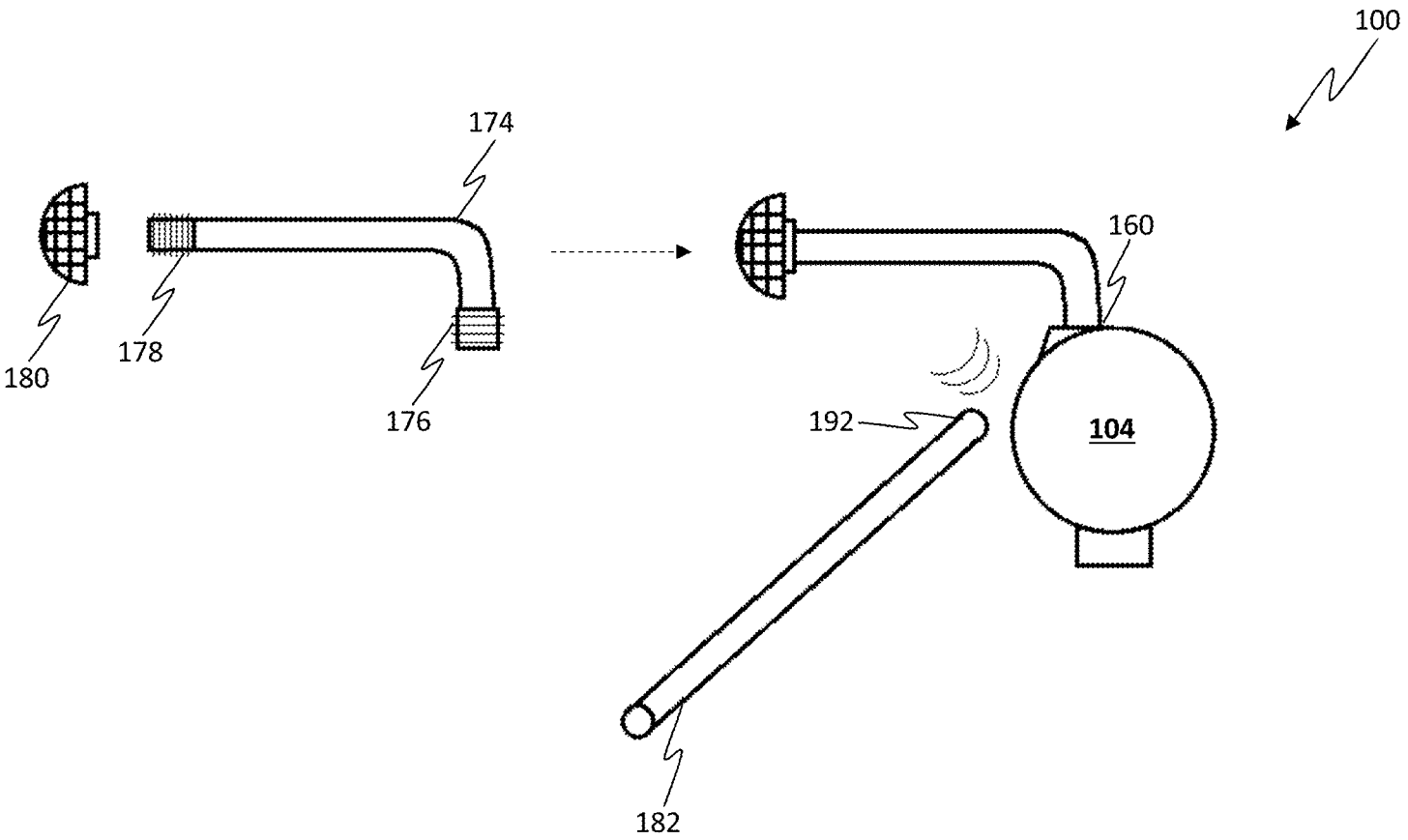
FIG. 3C is a front view of the PSDA of FIG. 1 associated with a preference wand, in accordance with one embodiment of the invention.
Figure 4:
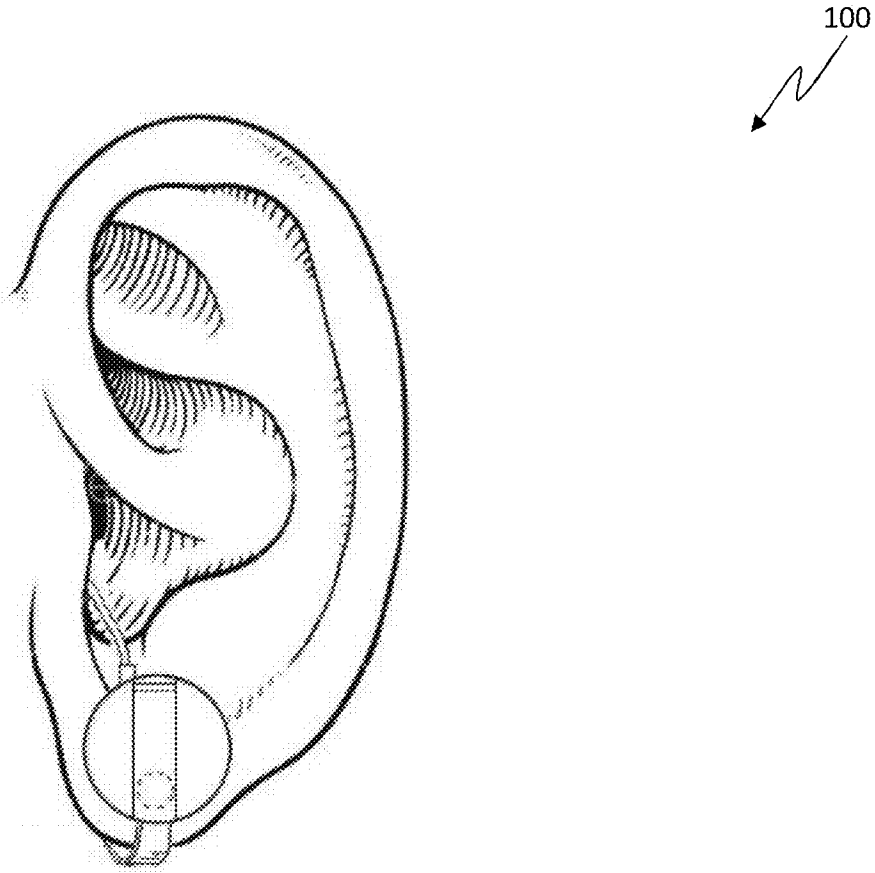
FIG. 4 is a view of the PSAD of FIG. 1 associated with the ear lobe of a user without a jewelry cover, in accordance with one embodiment of the invention.

In accordance with the present invention, a Personal Sound Amplification System (PSAS) is provided and includes one or more Personal Sound Amplification Devices (PSAD) that are configured to be worn as earring jewelry on the ear of a person. The PSAD is configured to receive sound, process the received sound and deliver the received sound through an external sound tube (or other delivery method) that traverses through the intertragal notch of a wearer's ear and into the wearer's ear canal. It is contemplated that embodiments of the PSAD also may incorporate a unique and novel adjustment system which utilizes a preference wand that wirelessly interacts with the PSAD to adjust various features, such as the tone and/or volume of the sound. In one embodiment, the PSAD may include a fully digital processor with advanced noise reduction and may provide the wearer with the ability to set the sound characteristics to their personal preference with either the preference wand, a user control button, and/or via a smart phone app. Additionally, the unique and novel design of the PSAD also allows the user to incorporate a decorative jewelry cover which may be attached to the PSAD via a variety of ways, such as via a magnetic clip.

These decorative covers may be used to help disguise the PSAD, wherein the covers may be able to be produced in unlimited designs that can help inspire the wearer to use them without the stigma of traditional hearing aid devices. Furthermore, it is contemplated that in some embodiments, the decorative covers may be used to receive and channel sound waves to microphones in the PSAD thereby allowing the decorative covers to be useful as directional receivers. Moreover, the PSAD may be worn on a part time or as needed basis, for example, restaurants, business meetings, theater, social events, etc. It is further contemplated that the PSAS may include one or more PSADs depending upon the needs of the wearer, wherein each of the PSADs may be separately programmable. For example, for a person that has hearing loss in only one ear, then only one PSAD may be required for the deficient ear, while a 'dummy' earring may be used for the normal hearing ear. While for a person that has hearing loss in both ears, two PSADs may be required, one for each ear. It is contemplated that each of the PSADs may be adjustable as a pair and/or they may be independently adjustable to allow people that have greater hearing loss in one ear to adjust each PSAD as required.

Referring to FIG. 1, FIG. 2A, FIG. 2B, FIG. 3A, FIG. 3B, FIG. 3C and FIG. 4, a Personal Sound Amplification Device (PSAD) 100 is shown in accordance with one embodiment and includes a receiving module 102 and a power module 104, wherein the power module 104 is movably connected to the receiving module 102 via a connecting member 106. The connecting member 106 includes a first member end 108 and a second member end 110, wherein the second member end 110 defines a connecting member cavity 112 which traverses the width of the second member end 110. The connecting member may be "J" shaped (or similarly shaped) such that the receiving module 102 and power module 104 define an article cavity 114 located between the receiving module 102 and the power module 104. When worn by a user, this "J" shaped connecting member 106 bends around the bottom of the wearer's earlobe thereby allowing the receiving module 102 to be located on the front portion of the wearer's earlobe and the power module 104 to be located on the rear portion of the wearer's earlobe, with the earlobe being disposed within the article cavity 114.

The power module 104 may include a power module body 116 which defines a power module body cavity 118 that is configured to contain a power supply/battery 120 and a power connector 122 which is associated with the power supply/battery 120. Additionally, the power module 104 further defines a connector cavity 124 and a pin cavity 126, wherein the connector cavity 124 is sized and shaped to contain the second member end 110 of the connecting member 106. Accordingly, a spring device 128 is located within the connector cavity 124 along with the second member end 110, wherein the second member end 110 compresses the spring device 128, such that the pin cavity 126 is aligned with the connecting member cavity 112. A mounting pin 130 is then located within the pin cavity 126 and the connecting member cavity 112. This configuration allows the connecting member 106 to rotate about an axis X that parallel to and extends through the mounting pin 130 and the pin cavity 126. Thus, the power module body 116 is movably connected to the connecting member 106 via the spring device 128, wherein the power module body 116 is resiliently rotatable about axis X between a first or closed configuration 132 and a second or open configuration 134, relative to the connecting member 106.

Accordingly, when the power module body 116 is disposed in the first configuration 132, the power module body 116 is located proximate the receiving module 102 and when the power module body 116 is disposed in the second configuration 134, the power module body 116 is located away from the receiving module 102. It should be appreciated that power module body 116 also may also include a body protrusion 136 which may be located on the power module body 116 to project into the article cavity 114. When the PSAD 100 is associated with a user, the body protrusion 136 advantageously compresses against the earlobe of a user to frictionally and/or compressingly interact with the user's earlobe to secure the PSAD 100 to the user's earlobe. It is contemplated that in other embodiments, the body protrusion 136 may be located on the connecting member 106 or on both the power module body 116 and the connecting member 106, as desired.

The receiving module 102 includes a receiving module body 137 having a module front 138, a module rear 140, a module top 142 and a module bottom 144. It should be appreciated that the receiving module body 137 defines a receiving module body cavity 146 for containing one or more of a processing device 148, an amplifier (which may be integrated with the processing device 148), a speaker 150, a first front microphone receiving port 152 communicated with a first front microphone 154, a second front microphone receiving port 156 communicated with a second front microphone 158, an antenna 159, a sound output nozzle 160 associate with the speaker 150 via an internal sound tube 162, an on/off switch (not shown), a magnetic switch 164 for programming the tone of the PSAD 100, a magnetic switch 166 for programming the volume of the PSAD 100, one or more attaching magnets 168 for magnetically interacting with a decorative jewelry cover 184, and a power input connector 170. It should be appreciated that the power input connector 170 of the receiving module 102 is connected to the power connector 122 of the power module 104 via a flexible power cable 172. It should be appreciated that the flexible power cable 172 advantageously electrically connects the electronic components of the receiving module 102 with the power supply/battery 120.

It should be appreciated that the PSAD 100 further includes an external sound tube 174, wherein the external sound tube 174 includes a module interface end 176 and a tube emission end 178 having a sound diffuser 180. The tube interface end 176 is configured to securely connect with the sound output nozzle 160 such that sound emanating from the sound output nozzle 160 enters the tube interface end 176 of the external sound tube 174, travels through the external sound tube 174, out of the tube emission end 178 and out of the sound diffuser 180. It should be appreciated that, as discussed herein, the receiving module body 137 may be configured to associate with a jewelry cover via either a clip, a magnet and/or a post to decoratively disguise the receiving module body 137.

The PSAD 100 further includes a preference wand 182 which may be configured to magnetically interact with the PSAD 100 to engage at least one of an on/off switch (not shown), a magnetic switch 164 for adjusting the tone of the PSAD 100 and the magnetic switch 166 for adjusting the volume of the PSAD 100. The PSAD 100 may be implemented by associating the PSAD 100 with the ear lobe of a user by locating the ear lobe within the article cavity 114 and by attaching the PSAD to the ear lobe in a similar fashion as a user would put on an earring that is meant for non-pierced ears. (i.e. compression). The external sound tube 174 is then configured so that the external sound tube 174 is located within the intertragal notch of a wearer's ear such that the sound diffuser 180 is located within the ear canal of the wearer.

Figure 5A:
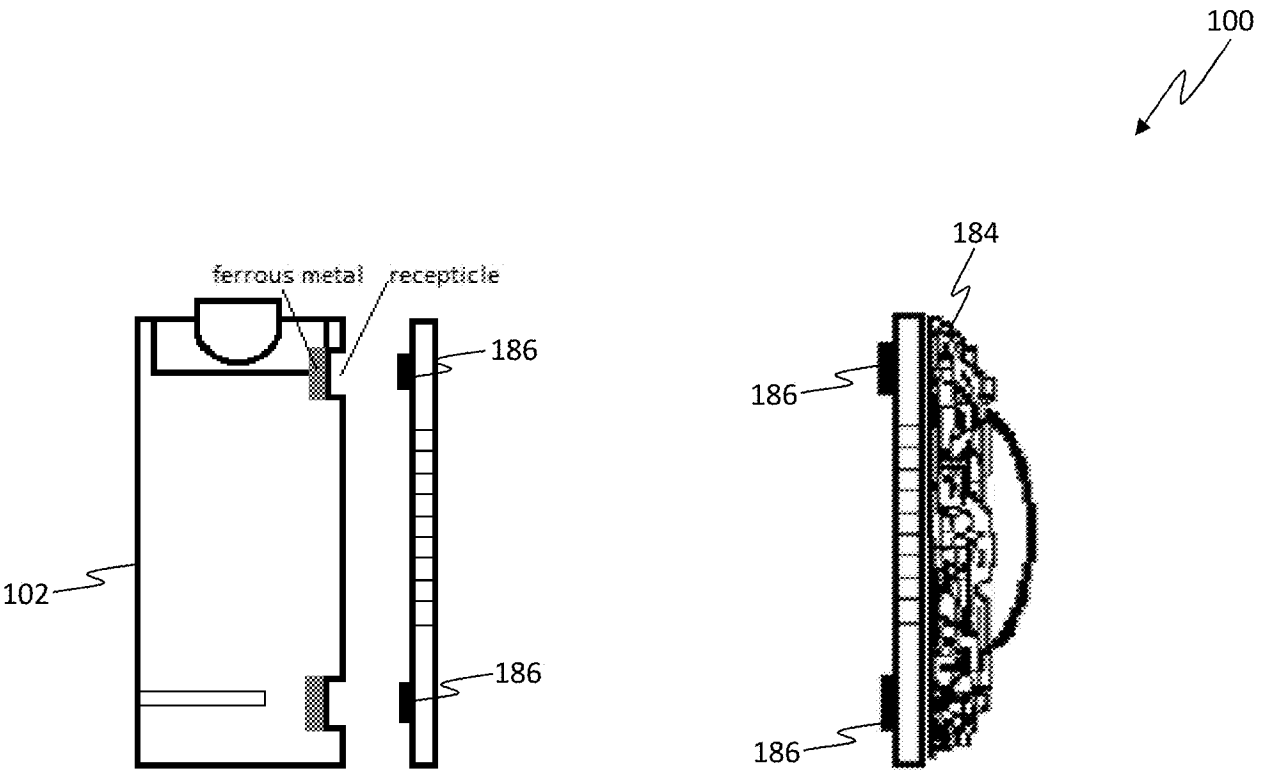
FIG. 5A is a side view of the receiving module of the PSAD of FIG. 1 associating with a jewelry cover, in accordance with one embodiment of the invention.
Figure 5B:
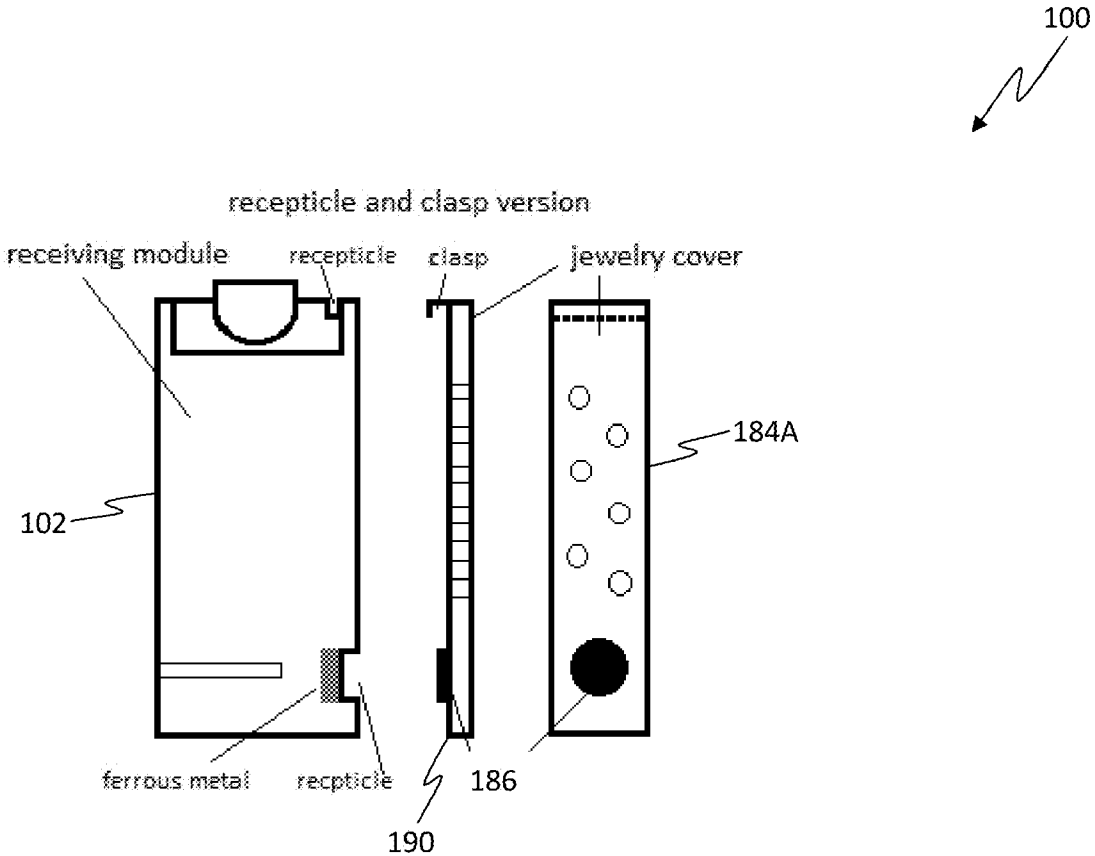
FIG. 5B is a side view of the receiving module of the PSAD of FIG. 1 associating with a jewelry cover, in accordance with another embodiment of the invention.
Figure 5C:
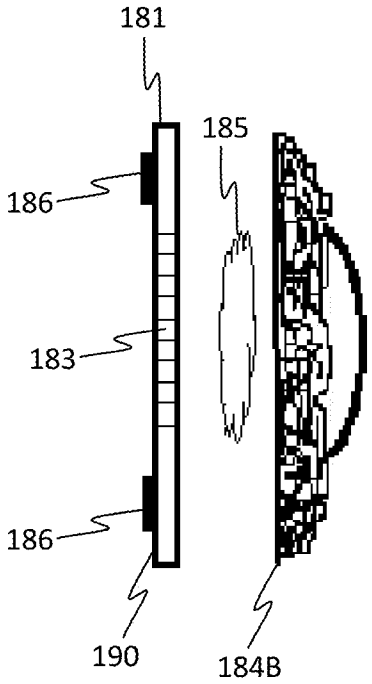
FIG. 5C is a side view of a jewelry cover configured to associate with the receiving module of the PSAD of FIG. 1, in accordance with still yet another embodiment of the invention.
Figure 5D:
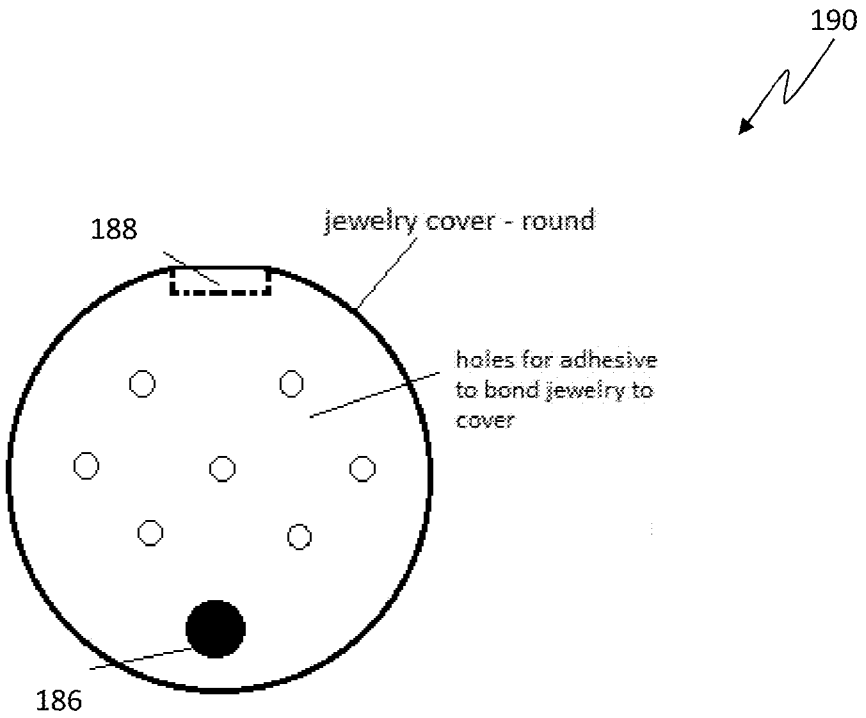
FIG. 5D is a front view of a mounting plate for use with a jewelry cover configured to associate with the receiving module of the PSAD of FIG. 1, in accordance with still yet another embodiment of the invention.

As discussed briefly hereinbefore, it should be appreciated that the PSAD 100 may be configured to associate with a decorative jewelry cover 184 which attaches to the receiving module body 137 to cover the module front 138. It should be appreciated that the decorative jewelry cover 184 may be removably associated with the receiving module body 137 via any device and/or method suitable to the desired end purpose. For example, in one embodiment the decorative jewelry cover 184 may include one or more magnets 186 which are located to magnetically engage with attaching magnets 168 (See FIG. 5A). While in another embodiment the decorative jewelry cover 184A may include a mounting plate 190 having a magnet 186 and an attaching clasp 188, wherein the magnet 186 magnetically engages with an attaching magnet 168 and the attaching clasp 188 engages with the receiving module body 137. The decorative jewelry cover 184A may then securely associate with the mounting plate 190 via a magnet 186 (See FIG. 5B). While in still yet another embodiment, the decorative jewelry cover 184B may include the mounting plate 190 which includes one or more magnets 186 that are located to magnetically engage with attaching magnets 168 to secure the mounting plate 190 to the receiving module body 137. The decorative jewelry cover 184 may then be secured to the mounting plate 190 via an adhesive (See FIG. 5C and FIG. 5D). It is contemplated that the PSAD 100 may be configured to turn on when the decorative jewelry cover 184 is associated with the receiving module body 137. This may be accomplished via any device and/or method suitable to the desired end purpose, such as a magnetic switch that senses when the decorative jewelry cover 184 magnetically engages with the attaching magnet(s) 168 and turns on the PSAD 100. It should be appreciated the decorative jewelry cover 184 may include a cover base 181 having one or more openings 183 to allow the jewelry cover 184 to be bonded to the cover base 185 via an adhesive 185.

Referring again to FIGS. 1-4, it should be appreciated that in one embodiment, the PSAD 100 is a two part housing design, wherein the front part houses the electronics (i.e. processing device 148, amplifier, speaker 150, two microphones 154, 158, antenna 159, sound output nozzle 160, magnetic on/off switch, magnet for jewelry clasp, user switches) and the rear part houses the power supply and the electrical connector connecting the power supply to the electronics. It is contemplated that the two microphones may be located on the underside of the front section to reduce incidence of failure and wind noise, while allowing maximum directionality to improve the ability to hear in noisy environments. The sound output nozzle 160 which may be directed out of and upwardly from the module top 142 may be offset to allow the external sound tube 174 to rest in the intertragal notch of a wearer's ear thereby allowing it to fit most ears.

Figure 6A:
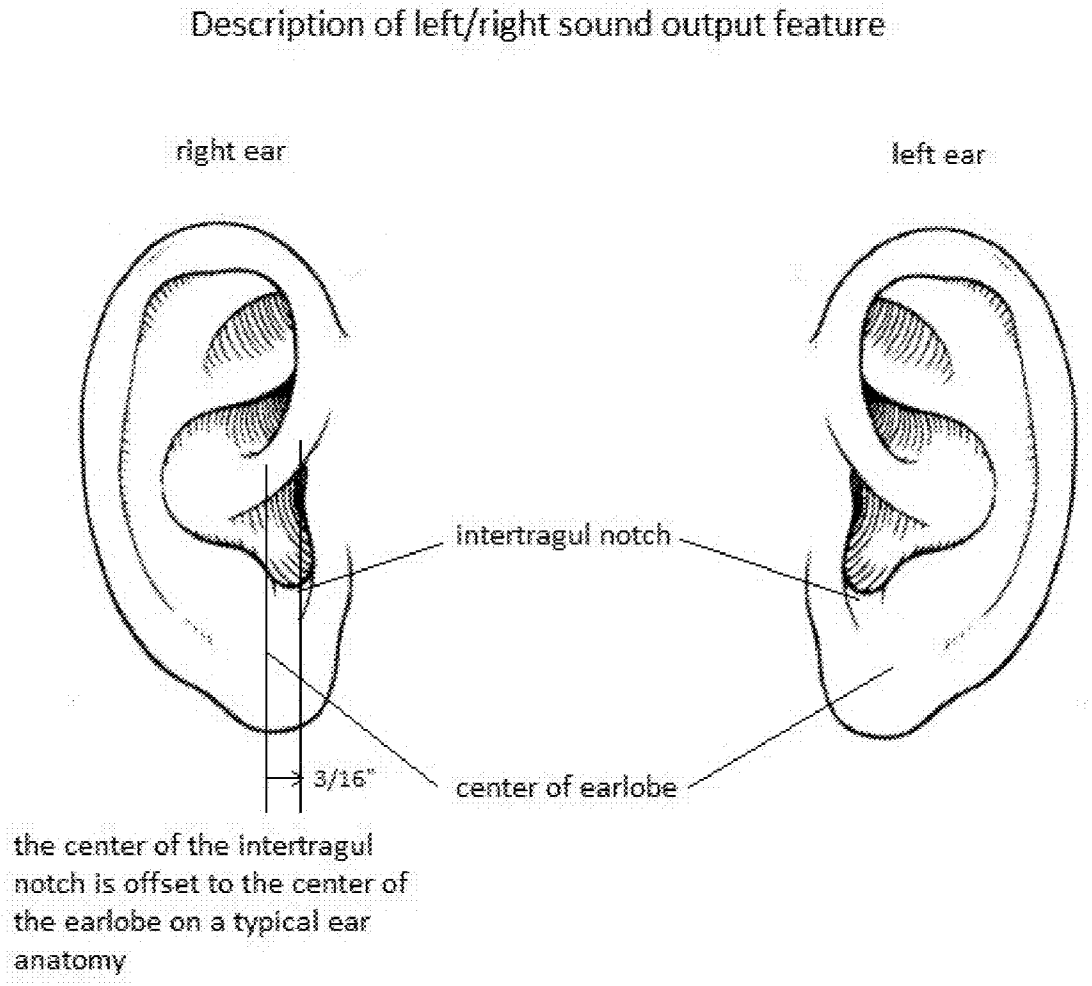
FIG. 6A is a front view of the left and right ears of a person.
Figure 6B:
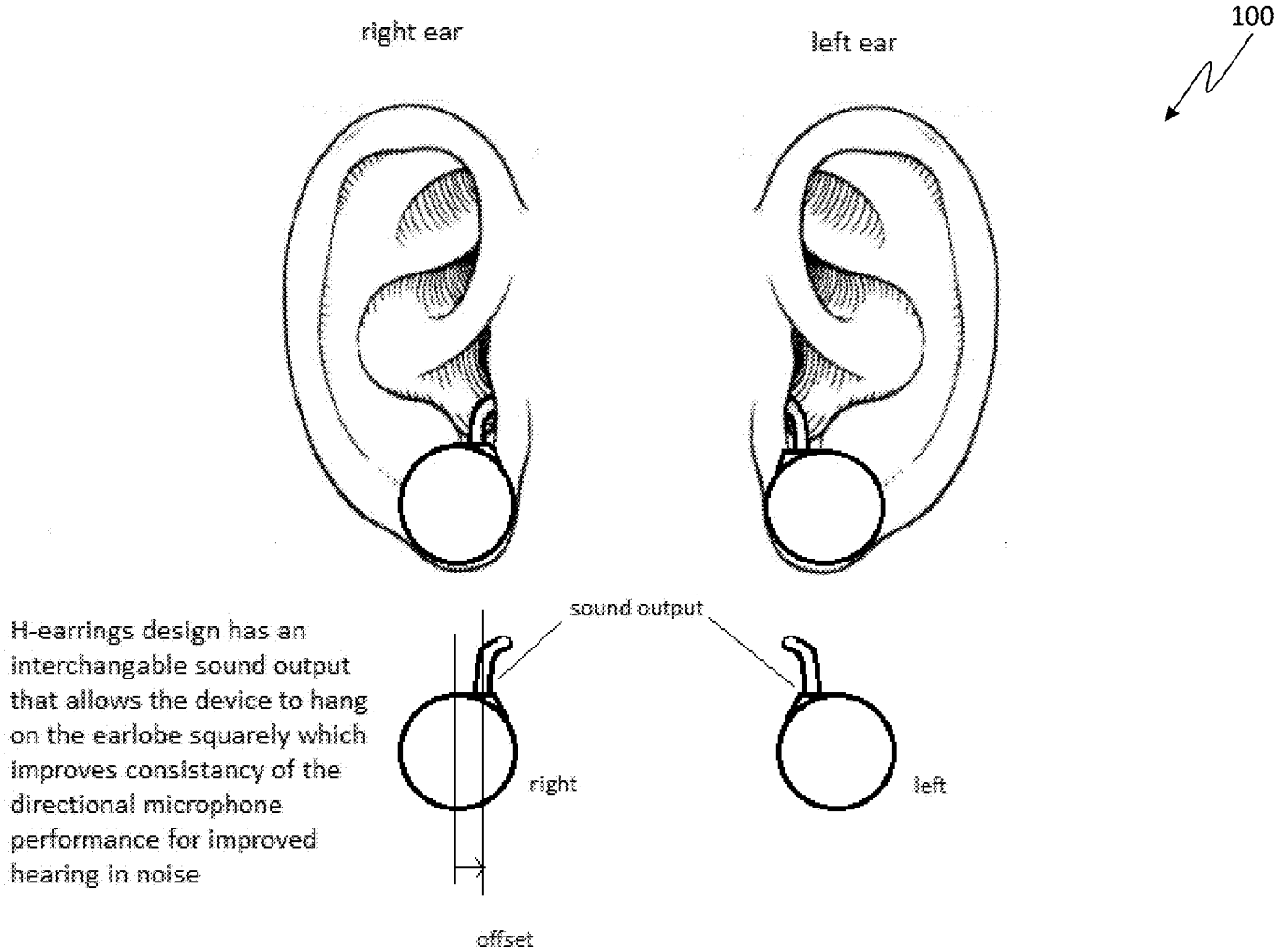
FIG. 6B is a front view of the PSAD of FIG. 1 associated with the left and right ear lobes of a person, in accordance with one embodiment of the invention.
Figure 7A:
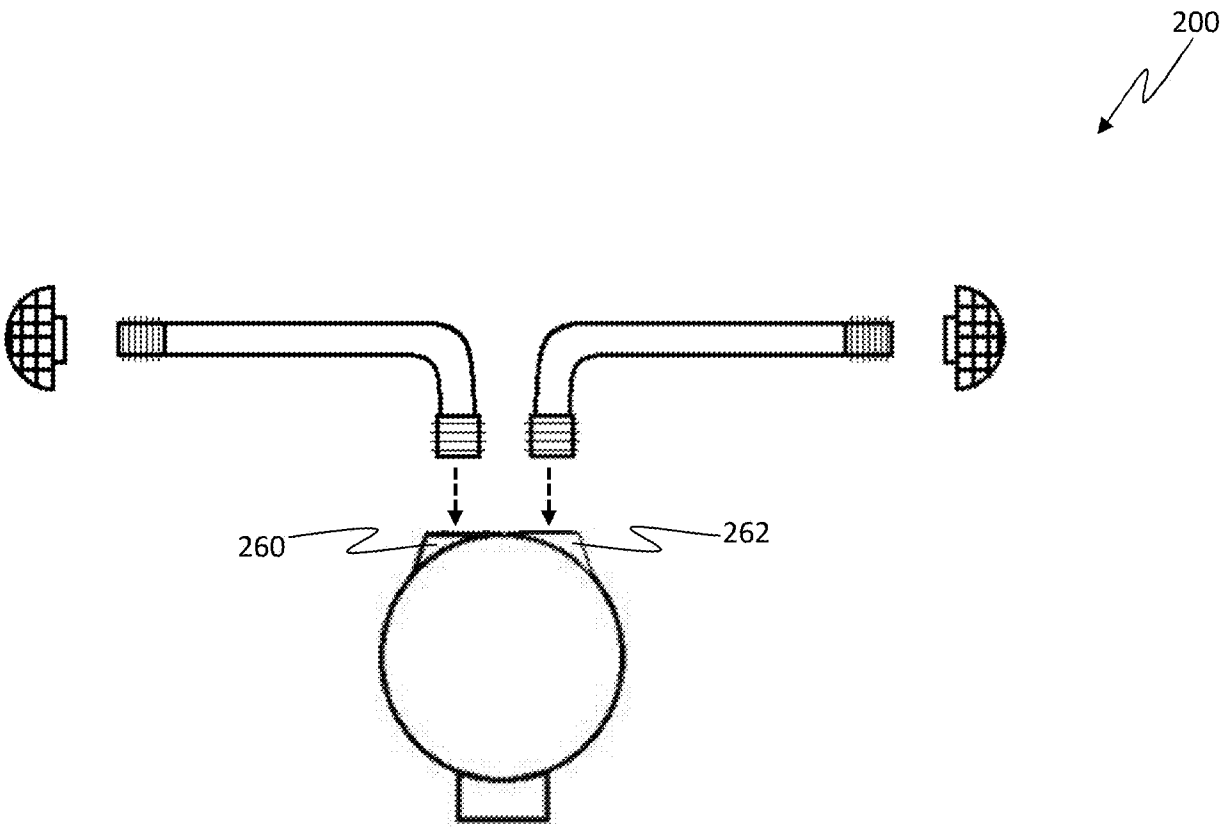
FIG. 7A is a front view of a PSAD having multiple sound output nozzles, in accordance with another embodiment of the invention.
Figure 7B:
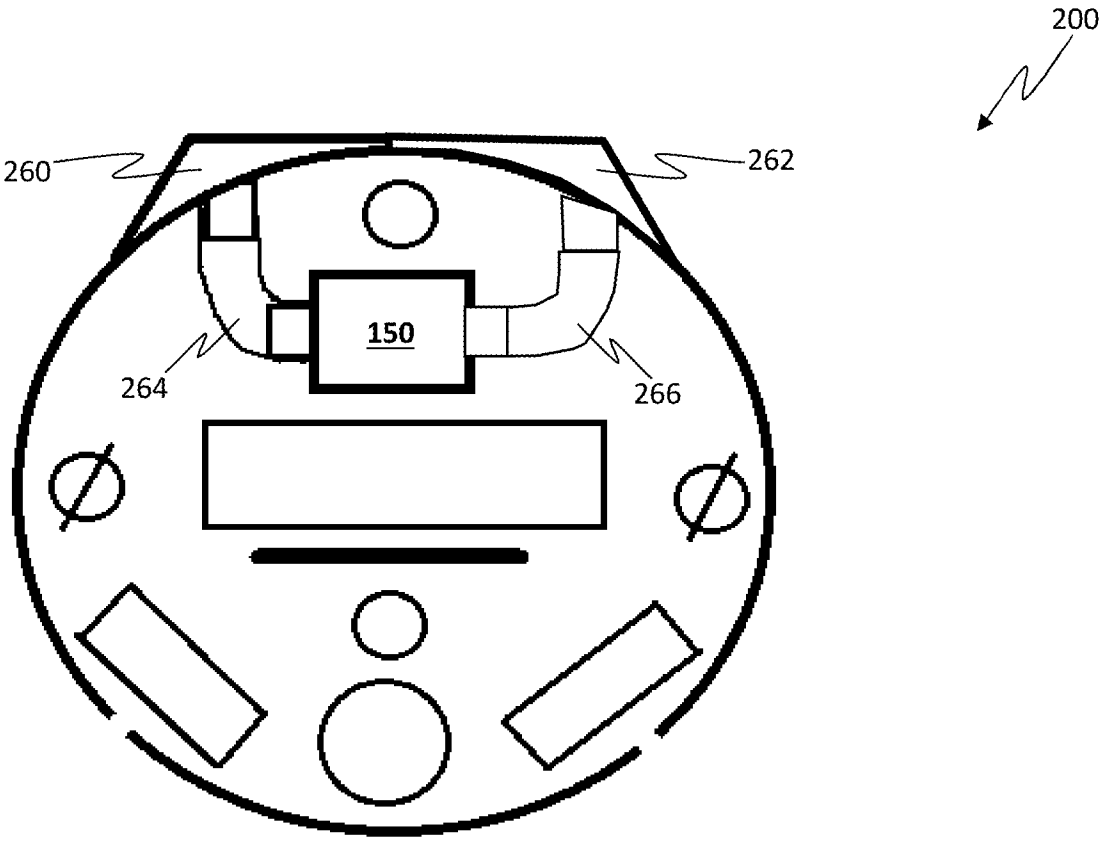
FIG. 7B is an internal view of the receiving module for the PSAD of FIG. 7A, in accordance with another embodiment of the invention.

It should be appreciated that the orientation of the ear structure on a person's left side is opposite the orientation of the ear structure on the person's right side. Thus, a device that is configured for the external sound tube 174 to be inserted into the intertragal notch of a left ear is not suitable for use in the right ear because the external sound tube 174 will be located too far from the intertragal notch. Referring to FIG. 6A and FIG. 6B, one way to address this issue is to make the PSAD 100 so that the PSAD 100 is configured for use in either the right ear or the left ear, as shown in one embodiment of the invention. Another way to address this issue is to include multiple sound output nozzles. Referring to FIG. 7A and FIG. 7B, a PSAD 200 having a first sound output nozzle 260 and a second sound output nozzle 262 is shown, in accordance with one embodiment of the invention, wherein the first sound output nozzle 260 is in audio communication with the speaker 150 via a first internal sound tube 264 and the second sound output nozzle 262 is in audio communication with the speaker 150 via a second internal sound tube 266. It should be appreciated that the PSAD 200 advantageously allows for the PSAD 200 to be used with either ear, as desired.

Figures 8A, 8B:
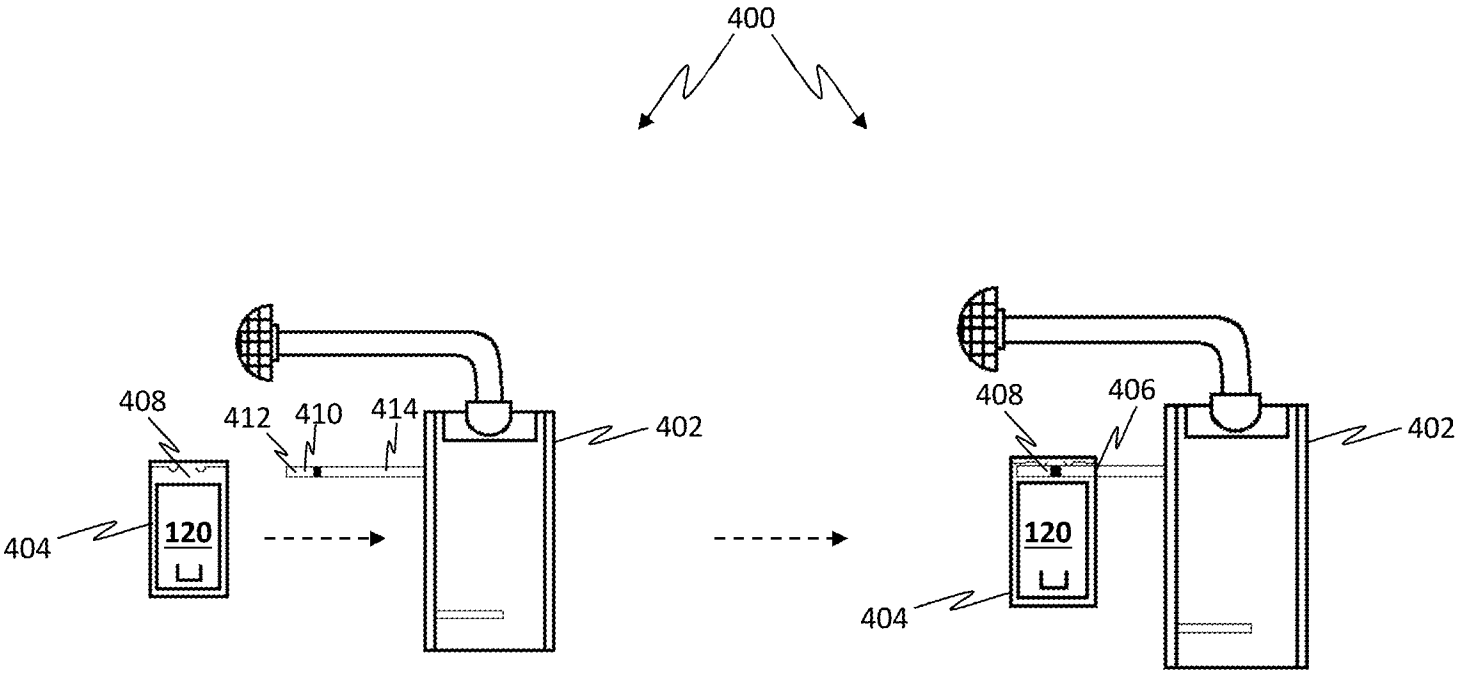
FIG. 8A is a side view of a PSAD configured for use with a user having pierced ears, in accordance with still yet another embodiment of the invention.
FIG. 8B is a side view of the PSAD of FIG. 8A.

Referring to FIG. 8A and FIG. 8B, a PSAD 400 configured for use by a wearer having pierced ears is shown, in accordance with another embodiment of the invention. The PSAD 400 includes a receiving module 402 and a power module 404, wherein the power module 404 includes a power opening 406 communicated with a power cavity 408 that is associated with the power source 120 contained therein. Additionally, the receiving module 402 includes a mounting post 410 which extends out of the module rear 440, wherein the mounting post 410 is configured to be in electrical connection with one or more of the electrical components located therein. The mounting post 410 may be configured as a dual pole contact stud having a mounting post first end 412 and a mounting post second end 414, wherein the mounting post first end 412 is configured as one polarity and the mounting post second end 414 is configured as the opposite polarity. Accordingly, if a potential difference exists between the mounting post first end 412 and the mounting post second end 414, then the electrical components within the PSAD 400 will be powered. It should be appreciated that the power cavity 408 is configured to removably and securely contain (mechanically and/or frictionally) the mounting post 410, when the mounting post 410 is contained therein. When the mounting post 410 is contained within the power cavity 408, the mounting post first end 412 is electrically associated with one polarity of the power source 120 and the mounting post second end 414 is electrically associated with the other polarity of the power source 120. Thus, when the mounting post 410 is contained within the power cavity 408, an electrical potential difference exists between the mounting post first end 412 and the mounting post second end 414. It should be appreciated that in this embodiment, the power module acts as a power source 120 and as an earring backing to secure the PSAD 400 to the ear of a wearer.

Figure 9:
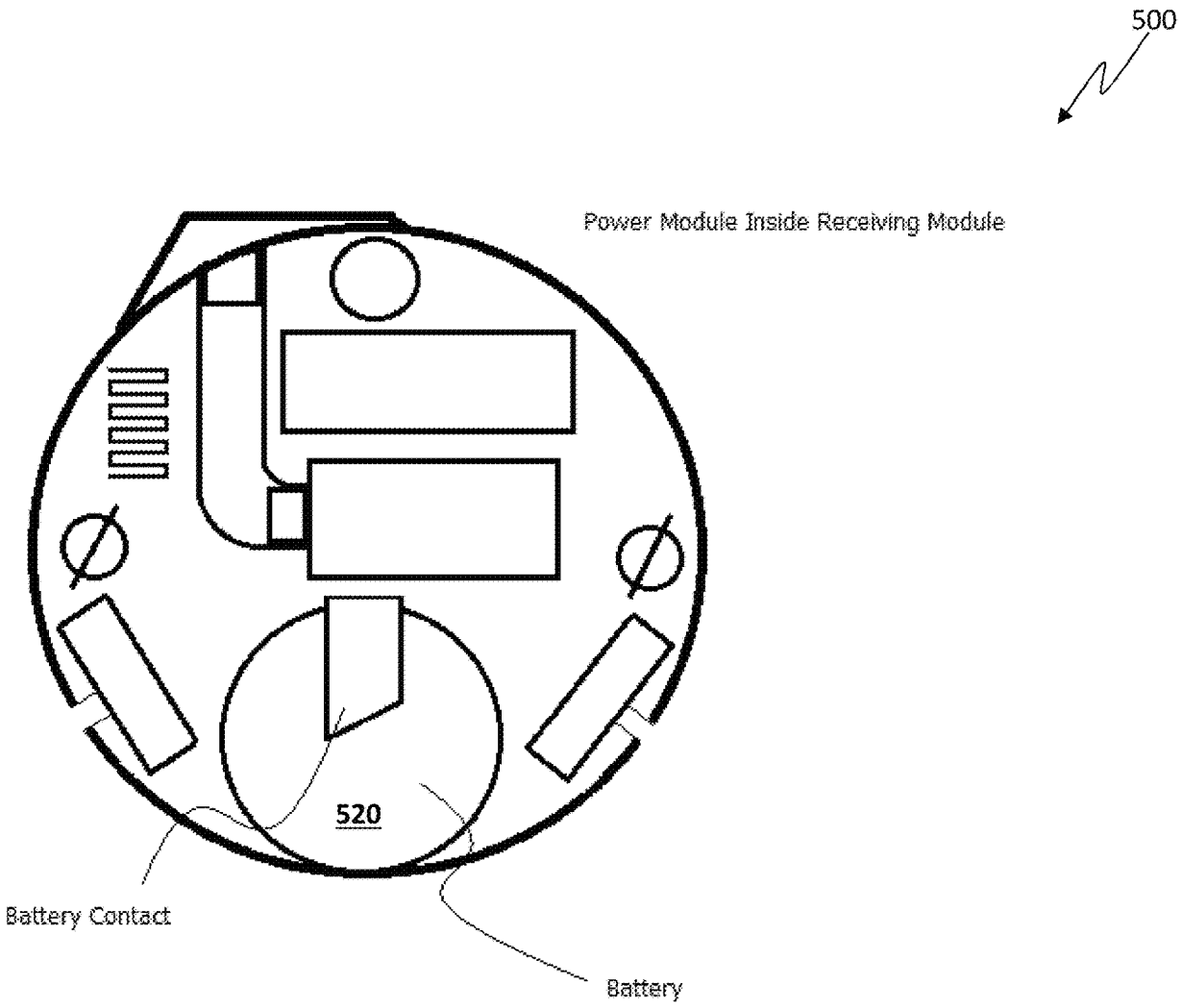
FIG. 9 is a internal view of the receiving module of a PSAD having an internal power source, in accordance with still yet another embodiment of the invention.
Figure 10:
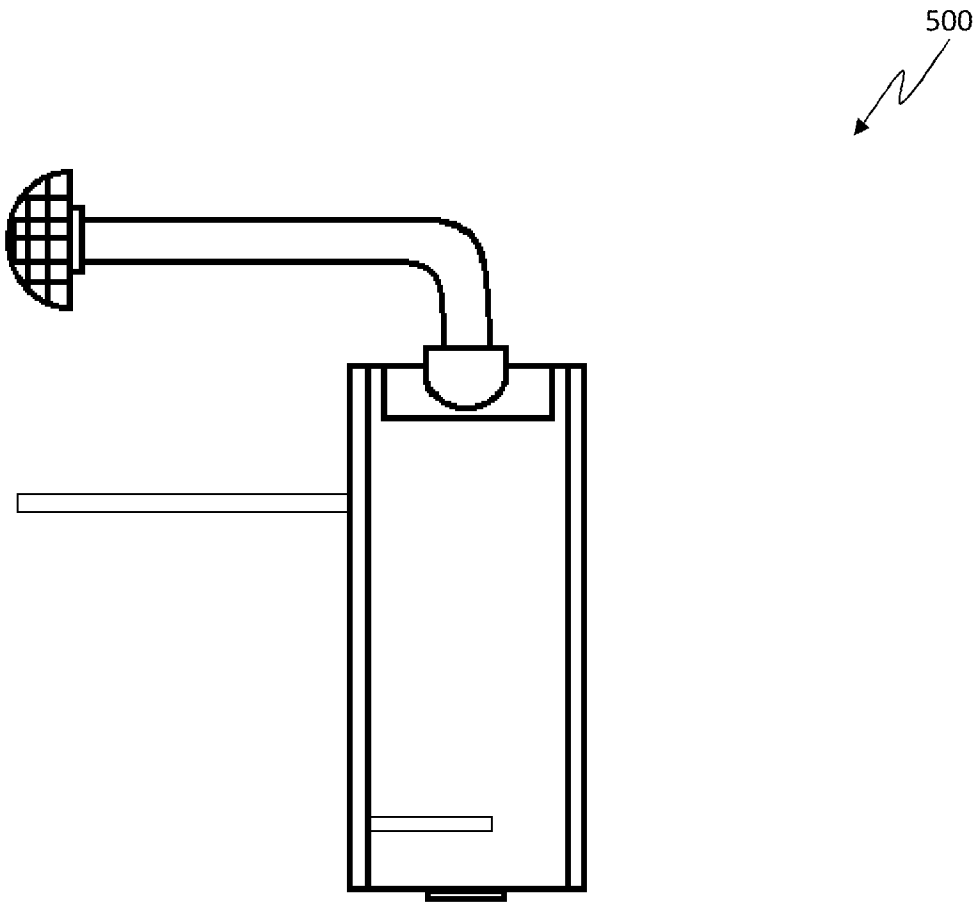
FIG. 10 is a side view of the PSAD of FIG. 9 configured for use with a user having pierced ears, in accordance with still yet another embodiment of the invention.
Figure 11:
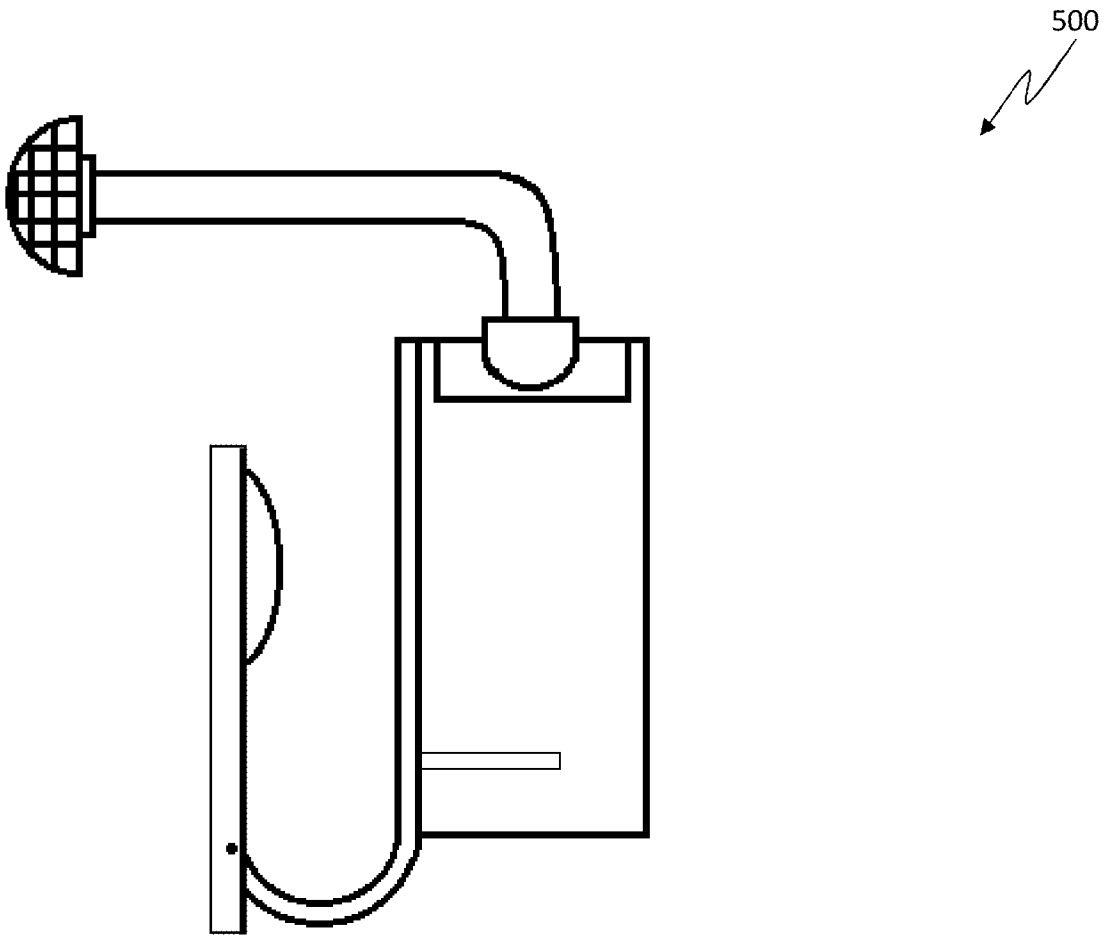
FIG. 11 is a side view of the PSAD of FIG. 9 configured for use with a user having non-pierced ears, in accordance with still yet another embodiment of the invention.
Figure 12:
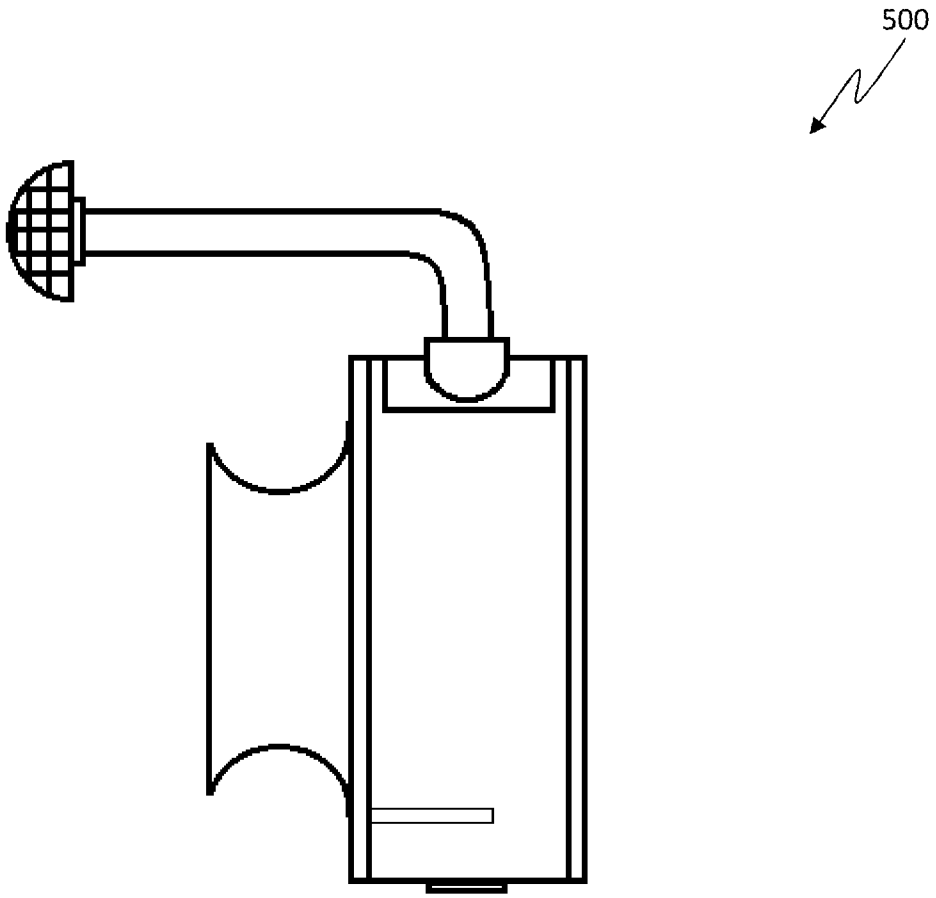
FIG. 12 is a side view of the PSAD of FIG. 9 configured for use with a user having pierced ears with larger ear holes, in accordance with still yet another embodiment of the invention.
Figure 13:
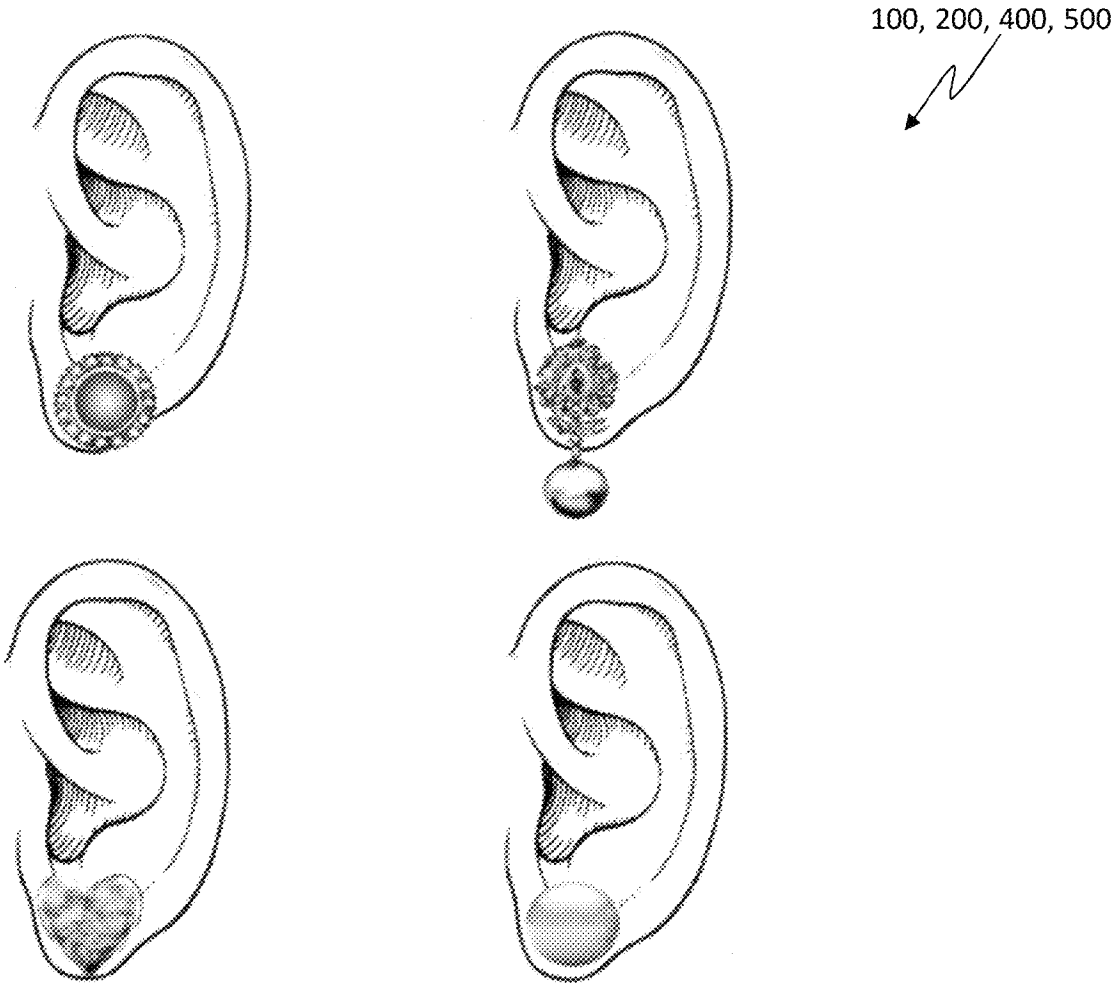
FIG. 13 is a view of the PSAD of FIG. 8A and FIG. 9 associated with a variety of ear lobes with various jewelry covers, in accordance with embodiments of the invention.

Referring to FIG. 9, a PSAD 500 that includes an internal power source 520 (i.e. battery) is shown, in accordance with still yet another embodiment of the invention. It should be appreciated that the PSAD 500 may be configured for use by wearers having pierced ears (See FIG. 10), non-pierced ears (See FIG. 11) and wearers with large gauge ear holes (See FIG. 12). Referring to FIG. 13, a variety of decorative jewelry covers are shown associated with PSAD 100, 200, 400, 500.

Figure 14A:
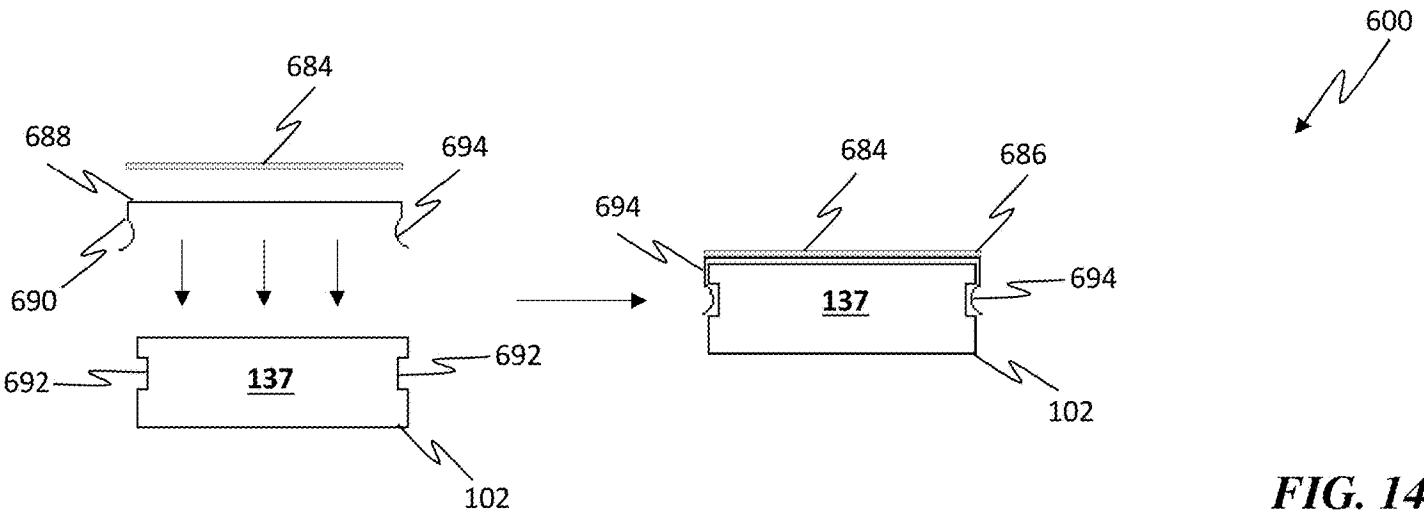
FIG. 14A is a side view of a jewelry cover associating with a receiving module of a PSAD, in accordance with another embodiment of the invention.
Figure 14B:
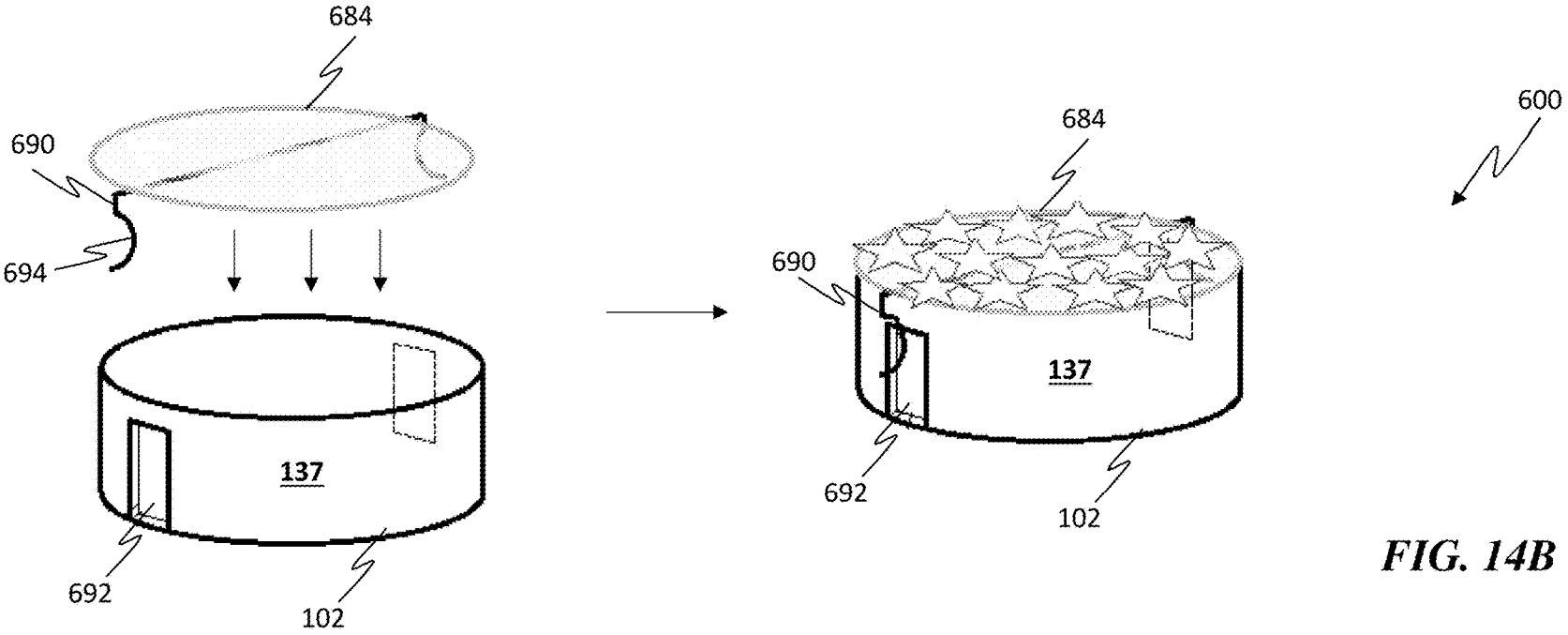
FIG. 14B is a side view of the jewelry cover of FIG. 14A illustrating a decorative jewelry cover associated with the receiving module of the PSAD of FIG. 14A.

Referring to FIG. 14A and FIG. 14B, another embodiment of the PSAD 600, showing still yet another way to connect a jewelry cover 684 to the receiving module 102 is illustrated. In this embodiment, the jewelry cover 684 includes a cover base 686 having a cover frame 688 and cover catches 690, wherein the cover catches 690 are resiliently connected to the cover frame 688 and extend perpendicular away from the cover frame 688. The receiving module 102 may include recessed portions 692 located on the side of the module body 137, wherein the recessed portions 692 are configured to receive and contain the cover catches 690. It should be appreciated that the cover catches 690 include a rounded portion 694 which seat within the recessed portions 692 when the cover base 686 is associated with the module body 137. It should be appreciated that the jewelry cover 684 is associated with the module body 137 by compressing the jewelry cover 684 onto the module body 137 such that the rounded portion 694 of the cover catches 690 contact the module body 137 and flex outwardly. When the rounded portions 694 of the cover catches 690 encounter the recessed portions 692, the rounded portions 694 become contained with the recessed portions 692 and return to their unflex configuration. It should be appreciated that the cover base 686 further includes a jewelry cover portion 684 which is connected to the cover frame 688.

As discussed hereinabove and referring again to the figures, in one embodiment, the decorative jewelry cover 184 may be connected to the module front 138 by means of a clip at the top of the module front 138 and an attaching magnet 168. It is contemplated that the PSAD 100, 200, 400, 500, 600 may be configured to turn on when the decorative jewelry cover 184 is associated with the receiving module 102, 402. Additionally, the preference wand 182 includes a magnetized end 192 may be included wherein with the preference wand 182 may be used to change the tone and volume level of the PSAD 100, 200, 400, 500, 600 by placing the magnetized end 192 of the preference wand 182 near the side of the receiving module 102, 402 so that the magnetized end 192 of the preference wand 182 interacts with the magnetic switch 164 and/or the magnetic switch 166. There may be an audible signal to indicate which tone and/or volume has been chosen. The setting may remain in effect until the next time the preference wand is used. It is contemplated that there may also be "dummy" units available for persons wearing only one amplifier device (monaural).

While the invention has been described with reference to an exemplary embodiment, it should be understood by those skilled in the art that various changes may be made and equivalents may be substituted for elements thereof without departing from the scope of the invention. Moreover, the embodiments or parts of the embodiments may be combined in whole or in part without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

We claim:

1. A Personal Sound Amplification System comprising:

a Personal Sound Amplification Device (PSAD), wherein the PSAD includes, a power module having a power source, and a receiving module, wherein the receiving module includes a receiving module body having a receiving module body attaching means, and a module body top and defining a receiving module body cavity for containing module electronics, wherein the receiving module is configured to removably associate with a decorative jewelry cover, wherein the receiving module body attaching means is a module body magnet and the decorative jewelry cover attaching means is a jewelry cover magnet, and wherein the module body magnet and jewelry cover magnet are configured to magnetically interact to securely associate the jewelry cover with the receiving module body; and an external sound tube, wherein the external sound tube is associated with the module body top of the receiving module.

2. The Personal Sound Amplification System of claim 1, wherein the module electronics include at least one of a processing device, an amplification device, a speaker, at least one microphone, a sound output nozzle associate with the speaker, at least one magnetic switch configured for programming at least one of the tone and volume of the PSAD.

3. The Personal Sound Amplification System of claim 2, wherein the external sound tube is in communication with the speaker and extends upwardly from the module body top.

4. The Personal Sound Amplification System of claim 2, wherein the at least one microphone includes a first microphone and a second microphone, and wherein the module body includes, a first microphone receiving port associated with the first microphone, and a second microphone receiving port associated with the second microphone.

5. The Personal Sound Amplification System of claim 1, wherein the module body includes a module body attaching means for attachingly engaging with the decorative jewelry cover, and wherein the decorative jewelry cover includes a jewelry cover attaching means for attachingly engaging with the module body.

6. The Personal Sound Amplification System of claim 1, wherein the power module includes a power module body defining a power module body defining a power module body cavity for containing the power source.

7. The Personal Sound Amplification System of claim 6, further comprising a connecting member, wherein the connecting member includes a connecting member first end securely associated with the receiving module body, and a connecting member second end movably and securely associated with the power module body.

8. The Personal Sound Amplification System of claim 7, further comprising a power cable, wherein the power cable is flexibly associated with the connecting member and is configured to electrically associate the power source with the module electronics.

9. A Personal Sound Amplification System comprising:

a Personal Sound Amplification Device (PSAD), wherein the PSAD includes, a receiving module, wherein the receiving module includes an a magnetic attaching means for associating with a decorative jewelry cover, and a receiving module body having a module body top and defining a receiving module body cavity for containing module electronics; and an external sound tube, wherein the external sound tube is associated with the module body top of the receiving module.

10. The Personal Sound Amplification System of claim 9, further comprising at least one of, a power source located within the receiving module body cavity, and a power module, wherein the power module includes a power source and is configured to electrically connect to the receiving module to power the module electronics.

11. The Personal Sound Amplification System of claim 10, wherein the receiving module body includes a module body attaching means for attachingly engaging with the decorative jewelry cover, and wherein the decorative jewelry cover includes a jewelry cover attaching means for attachingly engaging with the receiving module body.

12. The Personal Sound Amplification System of claim 11, wherein the decorative jewelry cover attaching means is at least one of a jewelry cover magnet and a metal portion configured to magnetically interact with the magnetic attaching means, and wherein the module body magnet and jewelry cover magnet are configured to magnetically interact to securely associate the jewelry cover with the receiving module body.

13. The Personal Sound Amplification System of claim 9, wherein the module electronics includes at least one of a processing device, an amplification device, a speaker, at least one microphone, a sound output nozzle associate with the speaker and a magnetic switch configured for programming at least one of the tone and volume of the PSAD.

14. The Personal Sound Amplification System of claim 10, further comprising a connecting member which connects the power module to the receiving module, wherein the connecting member is constructed from a resilient material to be configurable between a first configuration and a second configuration.

15. The Personal Sound Amplification System of claim 14, further comprising a power cable, wherein the power cable is flexibly associated with the connecting member and is configured to electrically associate the power source with the module electronics.

16. The Personal Sound Amplification System of claim 13, wherein the external sound tube is in communication with the speaker and extends upwardly from the module body top.

17. The Personal Sound Amplification System of claim 13, wherein the at least one microphone includes a first microphone and a second microphone, and wherein the module body includes, a first microphone receiving port associated with the first microphone, and a second microphone receiving port associated with the second microphone.

18. The Personal Sound Amplification System of claim 9, further comprising an antenna, wherein the PSAD is configured to wireless communicate with at least at least one of, a magnetic wand; and a wireless device.

19. The Personal Sound Amplification System of claim 18, wherein the magnetic switch is configured to program at least one of the tone and volume of the PSAD when the magnetic wand is located proximate to the magnetic switch.

* * * * *